United States Patent [19]

Tyler

[11] Patent Number: 4,970,998

[45] Date of Patent: Nov. 20, 1990

[54] OFFSET STARTER PAWL

[75] Inventor: Rex A. Tyler, Charlotte, Mich.

[73] Assignee: Eaton Indiana, Inc., Nappanee, Ind.

[21] Appl. No.: 357,196

[22] Filed: May 26, 1989

[51] Int. Cl.[5] ..... F02N 3/02

[52] U.S. Cl. ..... 123/185 B; 123/179 SE; 74/7 C; 74/577 R; 192/42; 192/46

[58] Field of Search ..... 123/185 A, 185 B, 185 BA, 123/185 R, 179 SE; 74/7 C, 577 S, 577 R; 192/42, 46

[56] References Cited

U.S. PATENT DOCUMENTS

| | | | |
|---|---|---|---|
| 677,592 | 7/1901 | Patrick | 192/46 |
| 1,292,274 | 1/1919 | Duncan . | |
| 1,632,300 | 6/1927 | Fever . | |
| 2,204,750 | 6/1940 | Conover | 123/185 BA |
| 2,293,322 | 8/1942 | Veach | 185/139 |
| 3,081,760 | 3/1963 | Hamman | 123/179 |
| 3,570,464 | 3/1971 | Morabit et al. | 123/185 |
| 3,782,355 | 1/1974 | Hamman | 123/185 B |
| 4,127,098 | 11/1978 | Frers et al. | 123/185 BA |
| 4,492,190 | 1/1985 | Greenwood et al. | 123/185 A |

FOREIGN PATENT DOCUMENTS

| | | | |
|---|---|---|---|
| 59-162362 | 9/1984 | Japan | 123/185 A |

*Primary Examiner*—Andrew M. Dolinar
*Attorney, Agent, or Firm*—Beaman & Beaman

[57] ABSTRACT

A pawl for a recoil starters for internal combustion engines wherein the pawl radially extends into a driving relationship with the engine to be started during cranking and retracts during recoiling of the starter mechanism or upon engine starting. The invention utilizes a pawl having a non-linear configuration wherein an increased pawl angle is achieved with respect to the operating mechanism to rapidly position the pawl during the engine cranking operation, and the pawl outer end approaches a tangential relationship to the engine mounted abutment engaged by the pawl end to improve the pawl engagement with the abutment and limit concentric misalignment of the starter with the engine during cranking.

6 Claims, 3 Drawing Sheets

OFFSET STARTER PAWL

BACKGROUND OF THE INVENTION

Recoil starters are widely employed with small internal combustion engines such as those used to power lawn mowers, outboard motors, and the like. Such starting apparatus commonly employs a pulley rotatably mounted on a shaft in concentric relationship to the engine flywheel and a rope is wound about the pulley for rotating the same. Drive mechanism in the form of a cup concentrically mounted upon the engine flywheel includes abutments or teeth which are selectively engaged by one or more pawls mounted upon the pulley structure. Pawl operating means is mounted upon the pulley shaft for extending the pawl or pawls radially outward into driving engagement with the engine cup abutments during rotation of the pulley in a cranking direction by tensioning the pulley rope. The pawls will automatically retract when the pulley is rotated in a non-cranking direction by a recoil spring of the coil type producing a biasing force on the pulley in a direction opposite the cranking direction. Pawls also retract without influence of pulley rotation whenever the engine rotates faster then the pulley as at the finish of the tensioning cycle or when the engine starts. Recoil starters of this general type are disclosed and explained in the assignee's U.S. Pat. No. 3,081,760 and 3,782,355.

Recoil starters of the aforementioned type pivotally mount the pawls upon pulley hub structure and the operating member for the pawls is either in the form an annular cup or a relatively flat plate. The cup or plate is rotatably mounted on and frictionally biased to the pulley shaft through a torsional drag brake mechanism, usually a spring, such that the cup or plate will initially not rotate with the pulley, but upon full extension of the pawls the drag brake will be overcome and the same will rotate with the pulley. The drag brake is sufficient to radially extend the pawls for engagement with the engine flywheel mounted abutment teeth while light enough to allow rewinding of the pulley or over running of the flywheel teeth past the pawls.

For purposes of symmetry and distribution of forces it is highly desirable that the pawls be employed in pairs or sets, and when two pawls are utilized they are mounted in a diametrical relationship with respect to the pulley hub, for this reason, but it is not uncommon for only a single pawl to engage an abutment producing asymmetrical forces. Because of the typical type of mounting of the starter housing upon a light sheet metal engine cooling shroud, flexing and misalignment occur.

Also, as high impact forces occur between the pawls and the engine flywheel mounted teeth wear at the end of the pawls occurs and excessive wear characteristics between the pawls and flywheel teeth exist with known starters.

It is an object of the invention to provide a pawl construction for internal combustion engine starters which limits eccentric misalignment of the starter and engine upon the occurrence of single pawl engagement, thus reducing stresses while protecting more vulnerable pulley sections with metal to metal contact points.

It is a further object of the invention to provide a pawl construction for internal combustion engine recoil starters wherein the configuration of the pawl causes the pawl to more rapidly extend relative to pulley rotation than previous designs and reduces the rotational pulley travel required to move both pawls out to the radius of the engagement teeth thus decreasing the possibility that only one pawl will engage.

Another object of the invention is to provide a pawl construction for recoil starters wherein the angle of engagement between the end of the pawl and the flywheel abutment teeth is improved to extend the life of the pawls and improve the mechanical characteristics of the engagement.

Yet another object of the invention is to provide a pawl construction for recoil starters wherein the pawls may be economically manufactured and are of a high strength design.

An additional object of the design is to provide a pawl construction for internal combustion engine starters which improves the engagement between a pawl and engine mounted abutment teeth upon the occurrence of eccentricity between the axis of rotation of the starter pulley and the engine starter structure and minimizes wear on the starter pulley.

It is another object of the invention to limit the maximum extension of the engaged pawl when the opposite pawl is not engaged and thus protect the pawl and its pivot socket from excessive stress.

In the practice of the invention a recoil starter for an internal combustion engine includes a pulley having a starter rope wound thereon. The pulley is rotatably mounted on a shaft and includes a hub, and a pair of pawls are pivotally mounted upon the hub. The pawls have an inner end of a cylindrical configuration so as to be pivotally received within cylindrical sockets defined in the pulley hub, and the outer ends of the pawls are capable of pivoting between radially extended and retracted positions. A pawl operator, in the form of a plate, is concentrically rotatably mounted upon the pulley shaft with a friction drag spring, and the operator plate includes configurations adapted to engage the pawls to radially outwardly extend the pawl outer ends, and also permit the pawl outer ends to radially retract inwardly during pulley recoiling.

The engine flywheel includes a plurality of abutment teeth defined on an annular ring or cup which are axially aligned with the pawls. As the pawls are extended outwardly the outer ends thereof will engage the abutment teeth and establish a positive driving connection between the starter pulley and engine flywheel to crank the engine for starting purposes. Retraction of the pawls releases the ends thereof from the abutment teeth to prevent interference and engagement when the engine begins to run or during pulley recoiling.

The pawls are provided with a knee or bend intermediate their inner and outer ends and this configuration defines an inwardly facing obtuse angle of the pawl regions adjacent the outer and inner ends. This configuration causes the pawl portion adjacent the pawl inner end to have an increased cam-angle with respect to the engagement with the pawl operating plate causing the pawl to outwardly extend quicker than with normal pawl constructions for a given degree of relative rotation between the pulley and plate. Additionally, the knee area is designed to contact the radially innermost portion of an abutment tooth when that pawl misses its engagement and significant eccentric deflection occurs. Further, the configuration of the pawl in accord with the invention causes the end region of the pawl adjacent the pawl outer end to approach a tangential relationship with respect to the movement of the engine flywheel abutment teeth thereby providing an improved angle of engagement between the pawl end and the abutment teeth with respect to wear and driving ability.

The pawls incorporating the inventive concepts may be formed of sheet metal by stamping operations, and in such instance a reinforcing gusset is preferably defined in the pawl knee, i.e. the transition bend between the pawl end regions.

BRIEF DESCRIPTION OF THE DRAWINGS

The aforementioned objects and advantages will be appreciated from the following description and accompanying drawings wherein.

DESCRIPTION OF THE PREFERRED EMBODIMENT

Figure 1:
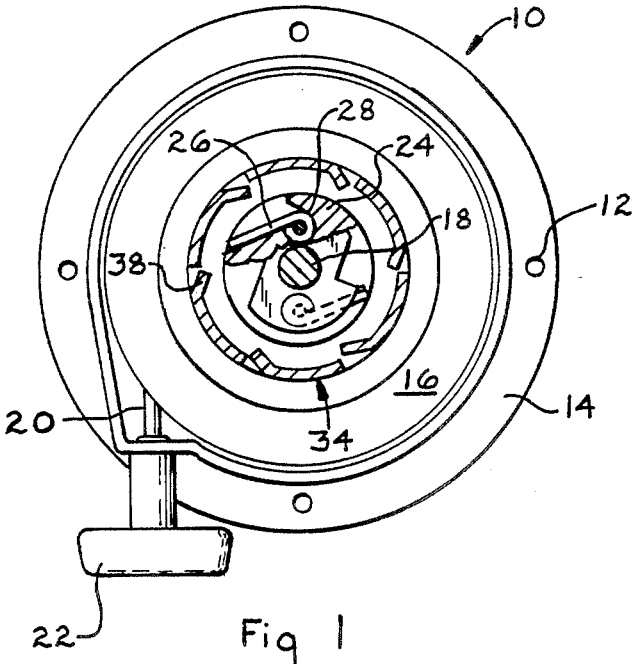
FIG. 1 is a plan, sectional view of a recoil starter mechanism showing the basic relationship of starter components, and utilizing the prior art type of starter pawl.

The basic relationship of components of the type of recoil starter with which the pawl of the invention is utilized is shown in FIG. 1 and conventional pawls are shown in this figure. With respect to the details of operation of this type of recoil starter reference is made to the assignee's U.S. Pat. No. 3,782,355, and the disclosure thereof is incorporated by reference.

Basically, a recoil starter as used with small internal combustion engines such as employed with lawn mowers, outboard motors, and the like consists of a starter housing 10 which is usually bolted to the internal combustion engine by means of bolts extending through holes 12 defined in the starter housing flange 14. The recoil starter structure includes a pulley 16 rotatably mounted on the housing by the shaft 18 and the pulley includes a groove in which the starter rope 20 is wound, the outer end of the starter rope being attached to a handle 22 whereby pulling upon the handle unwinds the rope from the pulley rotating the starter to crank the engine as is well known.

The pulley 16 includes a hub 24 rotatably receiving the shaft 18, and the hub, as illustrated, is designed for a pair of pawls as represented at 26. The pawls are in diametrical relationship to each other and each includes an inner end having a cylindrical pivot portion received within a cylindrical socket 28 defined in the pulley hub wherein the pawls may be pivotally positioned between the retracted position shown in FIG. 2 and the extended position shown in FIG. 3. A pawl actuating cam plate 30 is frictionally biased to the shaft 18 by a drag spring brake, not shown, so that the cam plate can rotate with the pulley hub, but will be frictionally restrained against rotation. The cam plate is notched as shown and includes radially extending fingers 32 adapted to engage the inside surface of the pawls for radially extending the pawls during initial rotation of the pulley in an engine cranking direction.

As illustrated, the engine mounted starter structure includes a drive cup 34 mounted upon the engine flywheel having an annular wall 36 normally concentrically related to the axis of the pulley rotation. The annular wall 36 is lanced at a plurality of locations as to inwardly deflect a plurality of abutment teeth 38 each of which includes an abutment end. The construction and mounting of the drive cup 34 will be readily appreciated from U.S. Pat. No. 3,782,355.

Figure 2:
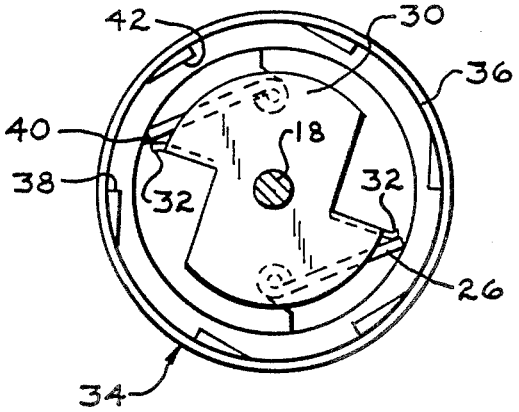
FIG. 2 is an enlarged, plan, sectional view taken through a conventional pulley hub utilizing conventional shaped pawls, the pawls being retracted and the starter and engine flywheel structure being concentrically related.
Figure 3:
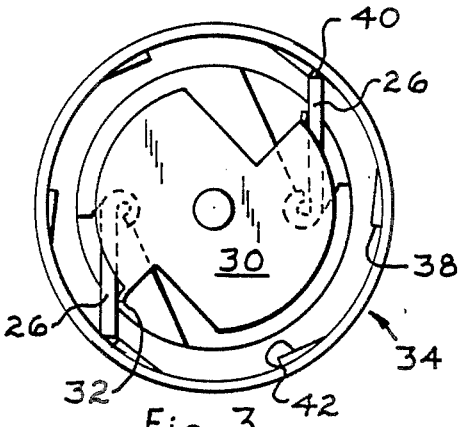
FIG. 3 is a view similar to FIG. 2 illustrating the pawls in the extended engine cranking position.

The relationship of components, and operation of the pawls will be readily appreciated from FIGS. 1, 2 and 3 wherein conventional pawls 26 are illustrated. As shown in FIGS. 1 and 2, the relationship of the cam plate 30 and cam plate fingers 32 to the pawls 26 will be such as to permit the pawls to be pivoted to the normal retracted position and the ends 40 of the pawls will be out of radial alignment with the teeth 38. In this position the engine may run without interference from the starter structure, and the cup 34 will be rotating with respect to the recoil starter components. The relationship of the pawls shown in FIGS. 1 and 2 is also that prior to the engine being started and prior to the pulley 16 being rotated during cranking.

When it is desired to start the engine the handle 22 is pulled to rotate the pulley 16 and pulley hub. As the cam plate will be frictionally restrained on the shaft 18 rotation of the pulley hub 24 in a counterclockwise direction causes the fingers 32 to engage the pawls 26 and pivot the pawls in a clockwise direction causing the pawl ends 40 to extend to the radial position of the annular wall 36 and then engage the cup teeth 38, FIG. 3. In this manner a positive driving connection is made between the pulley 16 and the cup 34 which will rotate the engine in a counterclockwise cranking direction for starting purposes. If the engine does not start the handle 22 is permitted to retract and the pulley will rewind the rope on the pulley under the influence of the pulley recoil spring, not shown. If the engine did not start on the first pull, the sequence will be repeated, and it will be appreciated that as the pulley is rewound in the clockwise direction the pawls 26 will move away from the cam plate fingers 32 allowing the individual pawl return springs, not shown, to retract the pawls out of engagement with the teeth 38. If the engine has started during rotation of the pulley or if the rope is not immediately released after pulling the cup 34 will begin to rotate faster than the pulley and the teeth ramp surfaces 42 will contact the outer end of the pawls and quickly pivot the pawls inwardly to prevent further contact of the teeth and pawls. It will be appreciated that as the pawls are thrust inward they will counter rotate the cam plate against its friction restraint.

It will be appreciated that due to the fictional mounting of the cam plate 30 on the shaft 18 that as soon as the ends of the pawls engage the key teeth 38 during starting the cam plate will rotate with the pulley and pawls, and conversely, during pulley recoiling the initial relative rotation between the pulley hub and the cam plate permits the pawls to spring retract, and thereafter the cam plate rotates to a rest position abutment on the pulley hub causing it to rotate with the pulley hub during the remainder of the recoiling of the pulley.

Figure 4:
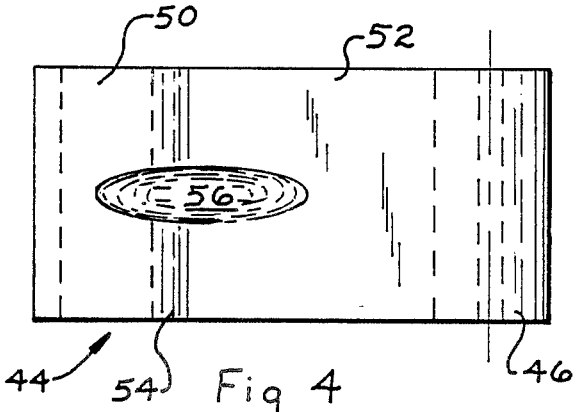
FIG. 4 is an enlarged elevational view of the improved pawl of the invention as taken from the top of FIG. 5.
Figure 5:
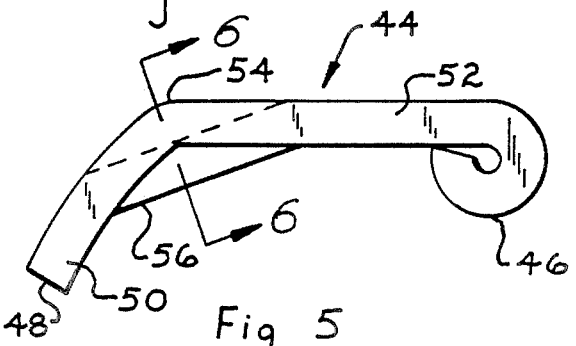
FIG. 5 is an enlarged, plan view of the improved pawl as taken from the bottom of FIG. 4.
Figure 6:
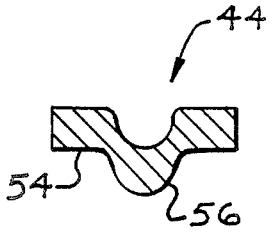
FIG. 6 is an elevational sectional view of the pawl of FIG. 5 as taken along Section VI—VI.

In the practice of the invention the pawl configuration shown in FIGS. 4–6 is utilized. The disclosed pawl 44 is preferably formed of stamped sheet metal and includes an inner end 46 formed of a substantially cylindrical configuration similar to the conventional pawl 26 shown in FIGS. 1–3 for reception into the pulley hub socket 28. The outer end of the pawl 44 includes the end 48, and an outer pawl end region 50 is adjacent the end 48, while the pawl end region 52 merges with the cylindrical end 48. The end regions 50 and 52 are substantially linear except that region 50 is slightly convex, FIG. 5, and intersect at a knee or transition region 54, and the included obtuse angle between the regions 50 and 52 is approximately 120°.

For reinforcement purposes, a gusset 56 is formed in the knee 54 by displacing an elliptical portion of the metal inwardly as will be appreciated from FIGS. 4 and 6. As the gusset deforms metal from the end regions the gusset substantially increases the resistance of the pawl to deform at the knee or transition during use.

Figure 7:
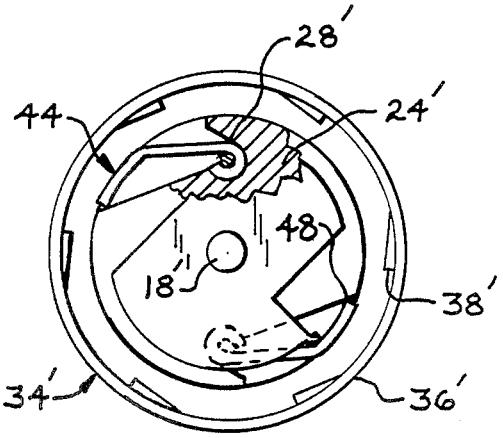
FIG. 7 is a plan sectional view of pulley hub and engine starter structure shown in concentric relationship when using the pawls of the invention shown in retracted position.

FIG. 7 illustrates the relationship of the starter components when utilizing the improved pawl construction. In the figures of the drawings identical components to those previously described are indicated by primed references.

As will be appreciated from FIG. 7 the cylindrical inner end 46 of the pawl is received within the hub socket 28, and the end region 50 extends beyond the cam plate fingers 32. However, as will be readily appreciated, the pawl end 48 is located inwardly spaced from the path of movement of the engine drive cup teeth 38.

Figure 8:
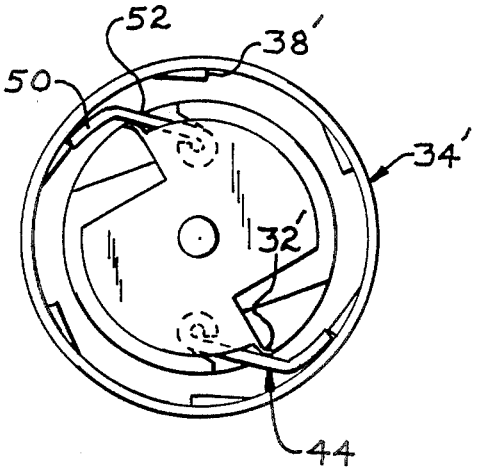
FIG. 8 is a view similar to FIG. 7 showing the pawls in the extended engine cranking position.

During starting the pulley hub will rotate in the counterclockwise direction causing the cam plate fingers 32 to engage the inside surface of the pawl end region 52 pivoting the pawls 44 in a clockwise direction, extending the pawl ends 48 to the radial position of the annular wall 36 for engagement with the drive cup teeth 38 as shown in FIG. 8. This relationship permits the pawls to rotate the drive cup 34 and crank the engine. Upon the engine starting or otherwise rotating faster than the pulley, the ramps 42 of the drive cup teeth will contact the outer portion of the knee 54 and the end region 50 pivoting the drive pawls in a counterclockwise direction and rotating the cam plate 30 counterclockwise in the known manner. If the engine did not start during the cranking cycle rotation of the pulley hub in the clockwise direction during recoiling also allows the pawl return spring, not shown, to rotate the pawls out of engagement with the teeth.

It will be appreciated that when utilizing the improved pawl construction, during cranking, the pawl end region 50 will be approaching a tangential relationship to the drive cup wall 36, FIG. 8, especially due to the convex configuration of region 50, and this relationship provides an improved approach and engagement of the pawl end 48 with the drive cup abutment teeth 38 as compared to that shown in FIG. 3 wherein conventional pawl construction is shown. This improved contact between the pawls and drive cup abutment teeth gives longer wear life to the pawl end and abutment teeth.

Figure 9:
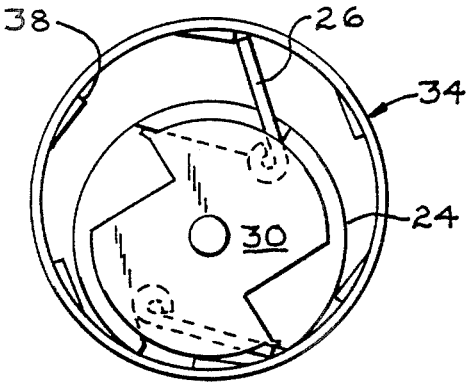
FIG. 9 is an enlarged, plan sectional view illustrating a conventional two pawl starter arrangement upon a single pawl engaging with an abutment tooth and under sufficient load to cause maximum lateral starter deflection to produce eccentricity between the pulley hub and starter flywheel structure the extent of eccentricity being exaggerated for purposes of illustration.

With engine recoil starters of the disclosed type wherein a plurality of pawls are used, it is not uncommon for one of the pawls to make engagement with a driving cup teeth before such engagement occurs by another pawl. This type of asymmetric pawl engagement imposes high lateral or radial forces between the recoil starter housing and the engine drive cup end will often laterally displace the starter housing relative to the engine axis of rotation, and such a relationship is shown in FIG. 9 wherein conventional pawls 26 are disclosed. Under these conditions, the pulley hub 24, which is preferably formed of a synthetic plastic material, is pushed into engagement with the steel abutment teeth 38 imposing highly undesirable wear upon the hub and allowing excessive pawl angular displacement which causes physical damage to the hub.

Figure 10:
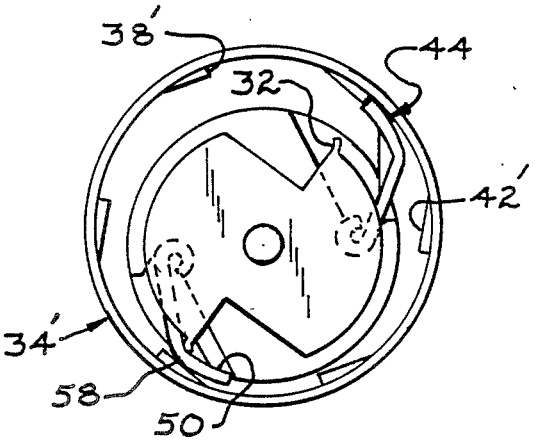
FIG. 10 is a view similar to FIG. 9 utilizing the pawls of the invention.

FIG. 10 illustrates a condition similar to FIG. 9, but when using the improved pawl of the invention. As will be appreciated from FIG. 10 the eccentric relative deflection between the pulley hub 24 and engine driving cup will cause the non-engaging pawl knee 54 to engage an abutment tooth ramp 42 as shown at 58 in FIG. 10, and this metal-to-metal contact between the pawl knee and the ramp protects the plastic pulley hub from engaging the drive cup and by limiting eccentric offset also limits the angular displacement of the engaged pawl as occurs when using conventional pawls as shown in FIG. 9.

Figure 11:
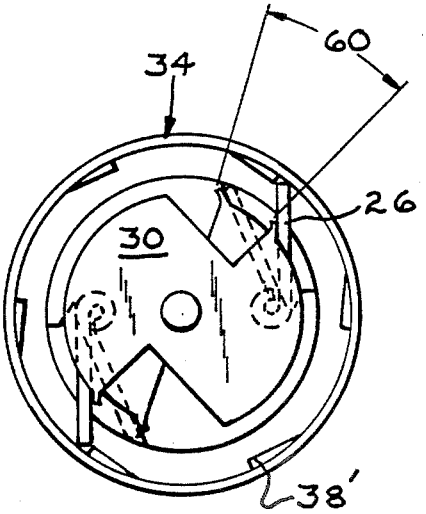
FIG. 11 is an enlarged, sectional view of starter structure utilizing convention pawls illustrating the pawls in the radially extended position in full lines, and in the retracted position in dotted lines.
Figure 12:
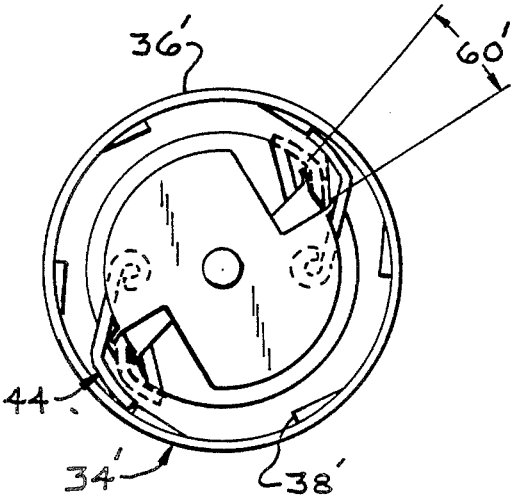
FIG. 12 is a view similar to FIG. 11 showing the starter components and utilizing the pawl of the invention, the outwardly extended pawl position being shown in full lines while the retracted position being shown in dotted lines.

A further improvement provided by the pawl 44 is apparent from the comparison between FIGS. 11 and 12. In FIG. 11 conventional pawls 26 are shown, and the position of the cam plate 30 between the pawl driving position and non-driving position is illustrated by angle 60. In the commercial construction this angle 60, which represents the amount of relative rotational movement that takes place between the pulley hub 24 and the cam plate 30 before the pawls 26 engage the abutment teeth 38 of the drive cup 34 is 27°.

In contrast, with the use of the offset pawl of the invention the relative rotation at angle 60 between the pulley hub and the cam plate necessary to pivot the pawls to their operative cranking position as shown in FIG. 12 is only 15°. This reduction in rotation is due to the "steeper" angular relationship present at the pawl end region 52 with respect to the associated finger 32 and this reduced requirement for pulley travel to move the pawls to engage a drive cup abutment tooth in an engaging relationship substantially reduces the possibility of one pawl engagements as shown in FIG. 10, which is a significant advantage over the prior art pawl construction.

In the drawings the pawl 44 is shown as being formed of sheet steel and is formed by stamping operations.

However, the pawl may be cast, forged or formed by extrusion.

It will be appreciated that various modifications to the inventive concepts may be apparent to those skilled in the art without departing from the spirit and scope of the invention.

I claim:

1. A starter pawl for recoil starters for internal combustion engines wherein the engine starter apparatus includes an annular rotatable cup having an axis of rotation and an inner circular surface having inward extending abutment teeth defined thereon, a starter housing, a rotatable starter drive member within the housing having an axis of rotation substantially parallel to the engine cup axis and axially located with the cup, at least one pawl pivotally mounted on the drive member selectively radially movable between a cup teeth engagement position and a cup teeth clearance position, and pawl positioning means mounted on the drive member for displacing the pawl from the cup teeth clearance position to the cup teeth engagement position upon rotation of the drive member in an engine cranking direction, the improvement comprising, the pawl comprising an elongated body including a pivot support pivotally mounting the pawl upon the drive member, an outer end, and a central region intermediate said pivot support and said outer end, said pawl body central region comprising a first body portion adjacent said outer end, and a second body portion adjacent said pivot support, said portions being interconnected at a transition region to form a knee shaped bend and said portions defining an obtuse angle whereby said pawl body first portion adjacent said outer end approaches a tangential relationship to the cup inner circular surface.

2. In a starter pawl as in claim 1, said pawl including an inner end, a pivot head defined on said inner end, a pivot socket defined on the drive member pivotally receiving said head, said pivot head comprising the pawl pivot support.

3. In a starter pawl as in claim 1, said pawl being formed of sheet material, and a reinforcing gusset being defined in the pawl body portions and said transition region.

4. In a starter pawl as in claim 1, the pawl being formed of an extrusion.

5. In a starter pawl as in claim 1, said first body portion being convex and said second body portion being substantially linear.

6. In a starter pawl as in claim 1, the pawl positioning means engaging said second body portion during rotation of the drive member in an engine cranking direction.

* * * * *